United States Patent [19]

Popescu

[11] 4,022,676

[45] May 10, 1977

[54] ALKALINE BRIGHT ZINC ELECTROPLATING BATH

[76] Inventor: Francine Popescu, 32 rue E. Dolet, 94 St. Maur, France

[22] Filed: Apr. 8, 1976

[21] Appl. No.: 674,960

[30] Foreign Application Priority Data

Apr. 9, 1975 France ..... 75.11045

[52] U.S. Cl. ..... 204/55 R

[51] Int. Cl.[2] ..... C25D 3/24

[58] Field of Search ..... 204/55 R

[56] References Cited

UNITED STATES PATENTS

| | | | |
|---|---|---|---|
| 3,075,899 | 1/1963 | Strauss et al. | 204/55 R |

FOREIGN PATENTS OR APPLICATIONS

| | | | |
|---|---|---|---|
| 609,086 | 11/1960 | Canada | 204/55 R |
| 1,915,653 | 10/1970 | Germany | 204/55 R |

*Primary Examiner*—R. L. Andrews
*Attorney, Agent, or Firm*—Gifford, Chandler, Sheridan & Sprinkle

[57] ABSTRACT

Brightening agents for alkaline zincate electroplating baths; either cyanide or non-cyanide-containing; are disclosed. The brighteners are polymers characterized by recurrent units of an alkylene amine wherein nitrogen atoms are bound to an aliphatic sulfoxylated group having the formula:

$$-R_1-SO_3M$$

where $R_1$ is selected from the group consisting of a lower alkylene group, a hydroxy substituted lower alkylene group, a lower alkyl substituted lower alkylene group, a lower alkoxy substituted lower alkylene group, a lower alkoxy substituted lower alkene group; and M is selected from the group consisting of hydrogen, an alkali metal, zinc and ammonium; where "lower" means having from 1 to 4 carbon atoms; and where said polymer is present in an effective concentration to produce bright, ductile, uniform, non-blistering zinc deposits.

30 Claims, No Drawings

ALKALINE BRIGHT ZINC ELECTROPLATING BATH

SUMMARY OF THE INVENTION

This invention relates to the electrodeposition of bright zinc from an alkaline aqueous zinc electroplating bath and, more particularly, to new brighteners and addition agents to be used in bright zinc electroplating.

According to the present invention, it has been found that bright, ductile and uniform zinc deposits, presenting no blisters, may be obtained from an alkaline, non cyanide, zinc electroplating bath containing an effective amount of a brightener consisting mainly of a water soluble, nitrogen-containing polymer, said polymer comprising recurrent units of an alkylene amine, in which one or several nitrogen atoms are bound to an aliphatic sulfonic group of formula:

$$R_1-SO_3M$$

where $R_1$ is a lower alkylene group, a lower hydroxy-alkylene group, a lower alkylene group substituted by a lower alkyl, a lower alkoxy-alkylene group, a lower alkylene group substituted by a lower alkyl, a lower alkoxy-alkylene group or a lower alkoxy-alkene group and M is selected from the group consisting of hydrogen, an alkali metal, zinc and ammonium. The term "lower" as used herein refers to a group having from 1 to 4 carbon atoms.

Typical polymers, in accordance with this invention, are the polyalkyleneimines reacted with a sulfoalkylating agent of formula:

$$R_2-SO_3M$$

where $R_2$ is lower hydroxy-alkyl, lower chloro-alkyl, lower bromoalkyl, lower alkyl substituted by halogen and hydroxy, lower alkyl substituted by halogen and methyl, lower hydroxy-alkoxy, alkene, alkyne, alkoxy-alkene or alkoxy-alkyne and M is as defined above.

Such polymers are the reacted polyethyleneimines of formula:

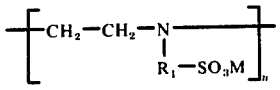

where $n$ is an integer from 2 to 500. N may be a primary, secondary, or tertiary nitrogen atom and M and $R_1$ are as defined above.

Other typical polymers ae the polymers obtained by first reacting an alkylene polyamine with an epihalohydrin or a dihalohydrin, the cationic polymer obtained in this way being further reacted with a sulfo-alkylating agent of formula $R_2—SO_3M$.

It should be noted that the polymers described in this invention are characterized by their amphoteric nature as opposed to certain polycationic polymers which have been added to zinc electroplating baths.

The preparation of the brightener polymers of the invention thus involve an alkylation wherein one or more aliphatic sulfoxylated groups $—R_1—SO_3M$ is attached to the primary, secondary or teritary nitrogen atoms belonging to the reacting polymer.

This reaction is achieved following the known methods of nitrogen alkylation. In a preferred method, the nitrogen containing polymer, or one of its salts with organic or inorganic acids, is reacted with the sulfoalkylating agent in aqueous or alcoholic medium, at acidic or alkaline pH, and a temperature in the range of about 40°–150° C.

A preferred ratio of sulfoalkylating agent to polymer in the foregoing reaction is between 2/1 and 1/10.

Generally, 1 mole of sulfoalkylating agent is added for each atom-gram of nitrogen to be sulfoalkylated. Practically, a proportion of such alkylating agent is selected so that 10 to 50 percent of the primary, secondary and tertiary nitrogen atoms of the reacting polymer are sulfoalkylated.

Typical sulfoalkylating agents which may be utilized for the preparation of the desired amphoteric polymers are the alkylsultones, the aliphatic saturated sulfonic acids substituted by at least one hydroxy group and/or by one halogen atom, and the aliphatic unsaturated sulfonic acids.

In Table 1 are given non limiting examples of sulfoalkylating agents which may be utilized for the preparation of brighteners for alkaline zinc electroplating, according to this invention.

TABLE I

| SULFOALKYLATING AGENTS ($R_2—SO_3M$) | |
|---|---|
| propanesultone | $O—(CH_2)_3—SO_2$ |
| butanesultone | $O—(CH_2)_4—SO_2$ |
| 2-hydroxyethanesulfonic acid | $HO—CH_2—CH_2—SO_3H$ |
| chloro-2-ethanesulfonic acid | $Cl—CH_2—CH_2—SO_3H$ |
| bromo-2-ethanesulfonic acid | $Br—CH_2—CH_2—SO_3H$ |
| 3-hydroxypropanesulfonic acid | $HO—CH_2CH_2—CH_2SO_3H$ |
| 3-chloropropanesulfonic acid | $Cl—CH_2—CH_2CH_2—SO_3H$ |
| 3-chloro-2-hydroxypropane-sulfonic acid | $Cl—CH_2—CH(OH)—CH_2—SO_3H$ |
| 3-chloro-2-methyl-propanesulfonic acid | $Cl—CH_2—CH(CH_3)—CH_2—SO_3H$ |
| 4-hydroxybutanesulfonic acid | $HO—(CH_2)_4—SO_3H$ |
| vinylsulfonic acid | $H_2C=CH—SO_3H$ |
| allysulfonic acid | $H_2C=CH—CH_2—SO_3H$ |
| propynesulfonic acid | $HC\equiv C—CH_2—SO_3H$ |
| 2-propynoxy-1-ethane-sulfonic acid | $HC\equiv C—CH_2—O—CH_2—CH_2—SO_3H$ |
| 2-propenoxy-1-ethane-sulfonic acid | $H_2C=CH—CH_2—O—CH_2—CH_2—SO_3H$ |
| hydroxy-ethoxy-ethane-sulfonic acid | $HO—CH_2CH_2—O—CH_2CH_2—SO_3H$ |

Instead of the sulfonic acids, described in Table 1, one may utilize advantageously their alkali metal, ammonium or zinc salts.

The following aminated polymers are preferred, according to this invention, for being reacted with a sulfoalkylating agent:

a. a polyethyleneimine of molecular weight in the range of about 400–100,000 or its hydrochloride. Such polymers having a molecular weight of about 700 are particularly valuable.

b. a polyethyleneimine partially substituted by one or several lower alkyl groups; i.e., a polyethyleneimine in which one or several of its hydrogen atoms are replaced by lower alkyl groups and comprising the substitution derivatives in which one or several hydrogen atoms belonging to this lower alkyl group are replaced by an hydroxy, carboxy, carboxy-ester, amino or halogen radical; the molecular weight of the substituted polyethyleneimines being preferably, in the range of about 100–60,000.

c. the polycationic polymers obtained by the reaction of ammonia, aliphatic amines or of alkylenepolyamines with epichlorohydrin or with aliphatic di-halogenated compounds. Such polymers are described in French Pat. Nos. 1,426,740; 74.22585 and 74.08259 and in U.S. Pat. No. 3,248,353. Their molecular weight in in the range of about 200–10,000.

One typical example is the polymer obtained by the reaction, in equimolar proportions, of the tetraethylenepentamine with epichlorohydrin or with alpha-dichlorohydrin, in aqueous or alcoholic medium and at a temperature of 40°–60° C.

In order to obtain bright zinc electrodeposits, a sulfoalkylated polymer, in conformity with those described in this invention, is added to an alkaline aqueous zinc electroplating bath, in a concentration of about 0.1–50 grams per liter, preferably 3 to 10 grams per liter of bath.

The following examples illustrate the preparation of the sulfoxylated polymers described in this invention:

EXAMPLE I 100 grams of a 50% aqueous solution of polyethyleneimine of molecular weight 700 are introduced into a reaction vessel together with 3.3 grams of sodium hydroxide, 100 grams of water and a solution of 10 grams of propanesultone in 40 grams of ethanol. The mixture is heated with stirring to 80°–90° C. and is maintained at this temperature for 2 hours.

The solution obtained, which contains about 25% of sulfoalkylated polymer, is used as alkaline zinc brightener, according to this invention.

EXAMPLE 2

100 Grams of a 50% aqueous solution of polyethyleneimine hydrochloride of molecular weight 1200 are introduced into a reaction vessel together with 12 grams of sodium hydroxide, 316 grams of water and 60 grams of the sodium salt of 3-chloro-2-hydroxypropanesulfonic acid. The mixture is heated at 90°–95° C with stirring for 3 hours.

The resulting solution, which contains about 25% of sulfoalkylated polyethyleneimine, is used as brightener for zinc electroplating, according to this invention.

EXAMPLE 3

With the same technique as in the above examples, 100 grams of an aqueous solution of polyethyleneimine hydrochloride of molecular weight 1500 is reacted with 20 grams of allylsulfonic acid in the presence of 170 grams of water at a pH of 6, at the refluxing temperature, and for 4 hours.

A 25% solution of sulfoalkylated polyethyleneimine is obtained, which is used as alkaline zinc brightener.

EXAMPLE 4

189.3 Grams (1 mole) of tetraethylenepentamine are introduced into a reaction vessel together with 200 grams of water and 92.5 grams (1 mole) of epichlorohydrin are added dropwise, so that the reaction temperature remains at 30°–50° C. 166.5 grams (1 mole) of the sodium salt of chloro-2-ethane are then added to the reaction mixture together with 40 grams of sodium hydroxide and 1600 gram of water. The solution is heated to 60°–70° C. for 4 hours. The result is a 25% solution of sulfoxyalkylated polymer which may be used as zinc electroplating brightener.

The bath used in accordance with the invention may comprise an aqueous solution of an alkaline zincate, such as sodium zincate, and an excess of alkaline hydroxide, such as sodium hydroxide. The bath may contain an alkaline cyanide if desired, but it is one of the objects of this invention to make the use of cyanide unnecessary and provide an alkaline, non-cyanide, zinc electroplating baths. The zinc metal concentration in this bath is usually in the range of about 6–20 grams per liter.

Further, the zinc electroplating bath of the invention comprises, dissolved therein, one or several sulfoxyalkylated aminopolymers, in conformity with those described above, in a total concentration of about 0.1 to 50 grams per liter, and preferably 3 to 10 grams per liter of bath.

Uniform, semi-bright to bright zinc electrodeposits are obtained from this bath at the usual operating conditions.

In order to further increase the brilliance of the zinc deposits one may add, additionally, one or several brighteners known in the art.

Such secondary brighteners are aromatic aldehydes, some quaternary pyridinium, quinolinium or isoquinolinium compounds, some reaction products of aromatic aldehydes with amines, and the natural or synthetic water soluble polymers largely used in the art, such as polyvinyl alcohol, various types of gelatin, the homopolymers of acrylamide, the copolymers of acrylamide with acrylic acid, and the homopolymers of acrylic acid and of methacrylic acid.

The concentration of these secondary brighteners in the plating bath is most advantageously in the range of about 0.05–10 grams per liter of bath.

One unique advantage is the combination, as brighteners, of the described suloxyalkylated polymers with the condensation products of aromatic aldehydes and heterocyclic amines compounds described in French Pat. No. 75.38636, and the combination with the quaternary aromatic heterocyclic compounds described in French Pat. No. 72.00707.

In Table 2 are given several non limiting, examples of secondary brighteners which may be combined with the above described sulfoalkylated polymers in order to increase the brilliance of the zinc deposits.

TABLE 2

| SECONDARY BRIGHTENERS | Optimum concentration in the zinc plating bath |
|---|---|
| 1. benzaldehyde | 0.1–1.5 g/l |
| 2. methyl benzaldehyde | 0.1–1.5 g/l |
| 3. methoxy benzaldehyde | 0.1–1.5 g/l |
| 4. hydroxy benzaldehyde | 0.1–1.5 g/l |
| 5. vanillin | 0.1–2.0 g/l |
| 6. piperonal | 0.1–1.0 g/l |
| 7. veratraldehyde | 0.05–1.0 g/l |
| 8. 2-styryl-pyridine | 0.05–1.0 g/l |
| 9. benzylidene-2′.2′ - dipyridylamine | 0.05–1.5 g/l |
| 10. 2-benzylaminopyridine | 0.05–1.2 g/l |
| 11. 3-hydroxy-3,6-dihydro-2H-pyrido-1,2-a-pyrimidine | 0.05–0.5 g/l |
| 12. 1-benzyl-pyridinium-3-carboxylate | 0.005–1.5 g/l |
| 13. The compound: 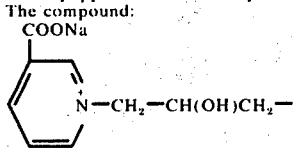 —O . OC . $CH_2CH(CH_3)Cl$ | 0.05–2.0 g/l |
| 14. gelatin | 1.0–5.0 g/l |
| 15. hydroxypropylgelatin | 1.0–5.0 g/l |
| 16. polyvinyl alcohol | 1.0–5.0 g/l |
| 17. sodium polyacrylate | 0.5–5.0 g/l |
| 18. copolymer of acrylic acid with poly acrylamide | 0.1–0.5 g/l |
| 19. sulfomethylated polyacrylamide | 0.1–1.0 g/l |

The following examples show typical zinc electroplating baths in accordance with this invention.

EXAMPLE 5

An alkaline zinc electroplating bath is made up according to the following basic formulation:

| | |
|---|---|
| sodium hydroxide | 140 grams |
| zinc oxide | 15 grams |
| Water to make one liter of solution. | |

To this bath are added the additives specified in the following examples:

EXAMPLE 6

To the bath of Example 5 is added:

| | |
|---|---|
| sulfoxyalkylated polymer solution obtained as per Example 1 | 15 g/l |

Using a cathodic current density of 0.1 to 3 amperes per square decimeter and at a bath temperature of 20°–35° C. semi-bright to bright, uniform and fine grained zinc deposits are obtained, which present no blisters.

EXAMPLE 7

To the bath of Example 5 is added:

| | |
|---|---|
| Sulfoxyalkylated polymer solution obtained as per Example 1 | 20 g/l |
| Veratraldehyde | 0.1 g/l |
| Vanillin | 0.1 g/l |

The two aldehydes are added as a 10% alcoholic solution.

Using 0.1 to 4 a/dm² cathodic current density; very bright, uniform and ductile zinc deposits are obtained.

EXAMPLE 8

To the bath of Example 5 is added: 1

| | |
|---|---|
| Sulfoxyalkylated polymer solution obtained as per Example 3 | 17 g/l |
| Compound No. 8 of Table 2 | 0.1 g/l |
| Compound No. 13 of Table 2 | 1.0 g/l |
| Compound No. 15 of Table 2 | 1.5 g/l |

Very bright and uniform zinc deposits are obtained using 0.1 to 7.0 a/dm² cathodic current density.

EXAMPLE 9

To the bath of Example 5 is added:

| | |
|---|---|
| Sulfoxyalkylated polymer solution obtained as per Example 4 | 15 g/l |
| Vanillin | 0.2 g/l |
| Compound No. 10 of table 2 | 0.3 g/l |
| Compound No. 19 of table 2 | 0.5 g/l |

The results are similar to those of Example 7.

The present invention is not limited to the above examples. The examples, however, will make apparent to one skilled in the art how to apply all the formulas and methods within the scope of the invention.

I claim:

1. In an electrolytic alkaline bath for electrodepositing bright zinc and comprising an aqueous solution of an alkaline zincate, the improvement which comprises: a polymer characterized by recurrent units of an alkylene amine wherein nitrogen atoms are bound to an aliphatic sulfoxylated group having the following formula:

$$-R_1-SO_3M$$

where $R_1$ is selected from the group consisting of a lower alkylene group, a hydroxy substituted lower alkylene group, a lower alkyl substituted lower alkylene group, a lower alkoxy substituted lower alkylene group, a lower alkoxy substituted lower alkene group; where M is selected from the group consisting of hydrogen, an alkali metal, zinc, and ammonium; where "lower" means having from one to four carbon atoms; and where said polymer is present in an effective concentration to produce bright, ductile, uniform, non-blistering zinc deposits.

2. The bath as defined in claim 1 wherein said concentration is about 0.1–50 grams per liter.

3. The bath as defined in claim 1 wherein said polymer has a molecular weight of about 400–100,000.

4. The bath as defined in claim 1 wherein said polymer has a molecular weight of about 700 and $R_1$ is $-CH_2-CH(OH)-CH_2-$.

5. The bath as defined in claim 1 wherein $R_1$ is $-CH_2-CH_2-CH_2-$.

6. The bath as defined in claim 1 wherein $R_1$ is $-CH_2-CH_2-CH_2-CH_2-$.

7. The bath as defined in claim 1 wherein $R_1$ is $-CH_2-CH_2-$.

8. The bath as defined in claim 1 wherein $R_1$ is $-CH=CH-CH_2-$.

9. The bath as defined in claim 1 wherein $R_1$ is $-C\equiv C-CH_2-$.

10. The bath as defined in claim 1 wherein said polymer is the reaction product of a polyalkylene amine with a compound selected from the group consisting of epihalohydrin and dihalohydrin.

11. The bath as defined in claim 1 and additionally comprising about 0.05 –5 grams per liter of an aromatic adehyde.

12. The bath as defined in claim 1 which additionally comprises about 0.05–5 grams per liter of sodium polyacrylate.

13. The bath as defined in claim 1 which additionally comprises about 0.05–3 grams per liter of the compound:

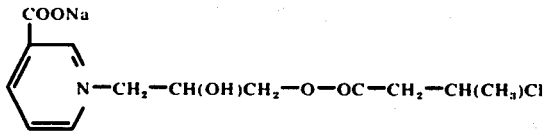

14. The bath as defined in claim 1 wherein said concentration is about 0.1–50 grams per liter; said polymer has a molecular weight of about 400–100,000; and wherein $R_1$ is a lower alkylene group.

15. The bath as defined in claim 1 wherein said polymer is a polyalkyleneimine reacted with a sulfoxyalkylating agent having the formula:

$$R_2—SO_3M$$

wherein $R_2$ is a hydroxy substituted lower alkyl, a halogen substituted lower alkyl, a halogen and hydroxy substituted lower alkyl, a halogen and methyl substituted lower alkyl, a hydroxy and lower alkoxy substituted lower alkyl, a lower alkene, a lower alkyne, a lower alkoxy substituted lower alkene, and a lower alkoxy substituted alkoxy alkyne.

16. The bath as defined in claim 15 wherein said polymer has a molecular weight of about 400–100,000.

17. The bath as defined in claim 15 wherein said polymer has a molecular weight of about 700 and $R_2$ is 3-chloro-2-hydroxy-propanesulfonic acid.

18. A method of forming bright zinc deposits on a basis metal which comprises the step of making said basis metal the cathode in an aqueous solution of an alkaline zincate plating bath comprising a polymer characterized by recurring units of an alkylene amine wherein nitrogen atoms are bound to an aliphatic sulfoxylated groups having the following formula:

$$—R_1—SO_3M$$

where $R_1$ is selected from the group consisting of a lower alkylene group, a hydroxy substituted lower alkylene group, a lower alkyl substituted alkylene group, a lower alkoxy substituted lower alkene group, where M is selected from the group consisting of hydrogen, an alkali metal, zinc, and ammonium; where "lower" means having from 1 to 4 carbon atoms; and where said polymer is present in an effective concentration to produce bright, ductile, uniform, non-blistering zinc deposits.

19. The method as defined in claim 18 wherein said concentration is about 0.1–50 grams per liter.

20. The method as defined in claim 18 wherein said polymer has a molecular weight of about 400–100,000.

21. The method as defined in claim 18 wherein said polymer has a molecular weight of about 700 and $R_1$ is $—CH_2—CH(OH)—CH_2—$.

22. The method as defined in claim 18 wherein $R_1$ is $—CH_2—CH_2—CH_2—$.

23. The method as defined in claim 18 wherein $R_1$ is $—CH_2—CH_2—CH_2—CH_2—$.

24. The method as defined in claim 18 wherein $R_1$ is $—CH_2—CH_2—$.

25. The method as defined in claim 18 wherein $R_1$ is $—CH=CH—CH_2—$.

26. The method as defined in claim 18 wherein $R_1$ is $—C\equiv C—CH_2—$.

27. The method as defined in claim 18 wherein said polymer is the reaction product of a polyalkylene amine with a compound selected from the group consisting of epihalohydrin and dihalohydrin.

28. The method as defined in claim 18 wherein said bath additionally comprises about 0.05–5 grams per liter of an aromatic aldehyde.

29. The bath as defined in claim 18 wherein said bath additionally comprises about 0.05–5 grams per liter of sodium polyacrylate.

30. The bath as defined in claim 18 wherein said bath additionally comprises about 0.05–3 grams per liter of the compound

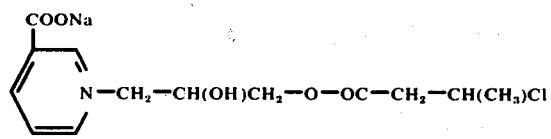

* * * * *